US009518409B2

(12) United States Patent
Shimura et al.

(10) Patent No.: US 9,518,409 B2
(45) Date of Patent: Dec. 13, 2016

(54) VEHICLE DOOR LATCH DEVICE

(71) Applicant: Mitsui Kinzoku Act Corporation, Yokohama-shi, Kanagawa (JP)

(72) Inventors: Ryoji Shimura, Yokohama (JP); Tomoharu Nagaoka, Yokohama (JP)

(73) Assignee: MITSUI KINZOKU ACT CORPORATION, Yokohama-shi (JP)

( * ) Notice: Subject to any disclaimer, the term of this patent is extended or adjusted under 35 U.S.C. 154(b) by 248 days.

(21) Appl. No.: 14/217,518

(22) Filed: Mar. 18, 2014

(65) Prior Publication Data

US 2014/0319852 A1 Oct. 30, 2014

(30) Foreign Application Priority Data

Apr. 25, 2013 (JP) ..... 2013-91945

(51) Int. Cl.
*E05C 3/16* (2006.01)
*E05B 85/02* (2014.01)
*E05B 79/08* (2014.01)

(52) U.S. Cl.
CPC ..... *E05B 85/02* (2013.01); *E05B 79/08* (2013.01); *Y10T 292/1047* (2015.04)

(58) Field of Classification Search
CPC ..... E05B 79/00; E05B 79/02; E05B 79/04; E05B 79/08; E05B 79/10; E05B 85/02
USPC .. 292/201, 216, 194, 198, DIG. 23, DIG. 53
See application file for complete search history.

(56) References Cited

U.S. PATENT DOCUMENTS 4,756,563 A * 7/1988 Garwood ..... E05B 85/243 292/216
4,763,936 A * 8/1988 Rogakos ..... E05B 81/14 292/201
5,035,454 A * 7/1991 Fukumoto ..... E05B 81/06 292/201
5,516,164 A * 5/1996 Kobayashi ..... E05B 81/20 292/201
5,785,366 A * 7/1998 Takaishi ..... E05B 85/243 292/216
6,089,056 A * 7/2000 Yoda ..... B29C 65/64 292/DIG. 29
6,601,885 B1 * 8/2003 Yiu ..... E05B 79/04 292/337
7,478,846 B2 1/2009 Yoshikuwa et al.
2012/0313385 A1 * 12/2012 Akizuki ..... E05B 85/26 292/216

FOREIGN PATENT DOCUMENTS

JP 2007-197973 A 8/2007

* cited by examiner

*Primary Examiner* — Alyson M Merlino
(74) *Attorney, Agent, or Firm* — Davis & Bujold PLLC; Michael J. Bujold

(57) ABSTRACT

A vehicle door latch device which comprises a body having a holding portion, an engagement member pivotally mounted in the holding portion, a cover member closing an opening of the holding portion, and a shaft comprising a shank which passes through a bearing hole of the body and a shank hole of the engagement member, a retaining head and a smaller-diameter shank. The shank passes through the shank hole of the engagement member and the smaller-diameter shank is pressingly fitted in the shank hole of the cover member without swaging the end of the smaller-diameter shank thereby assembling the vehicle door latch device more efficiently.

3 Claims, 13 Drawing Sheets

VEHICLE DOOR LATCH DEVICE

BACKGROUND OF THE INVENTION

The present invention relates to a vehicle door latch device, and particularly to a vehicle door latch device comprising a latch and a latch shaft.

In a vehicle door latch device in JP2007-197973A, a latch and a ratchet are held in a holding portion which has an opening in one surface, and the holding portion is held between a cover member for closing the opening and a back member attached on the other surface of the holding portion. From the side of the back member, a latch shaft for pivoting the latch and a ratchet shaft for pivoting the ratchet are inserted, and the latch shaft and the ratchet shaft which project from the cover member are caulked.

However, in the vehicle door latch device, the end of each of the shafts which project on the front surface is caulked, and the swaging hinders efficient assembling of the device.

In view of the disadvantage, it is an object of the present invention to provide a vehicle door opening device which can be assembled more efficiently.

BRIEF DESCRIPTION OF THE DRAWINGS

The features and advantages of the present invention will become clear from the following description with respect to the drawings as below.

DETAILED DESCRIPTION OF PREFERRED EMBODIMENT

FIGS. 1-7 illustrate a first embodiment of the present invention.

Figure 6:
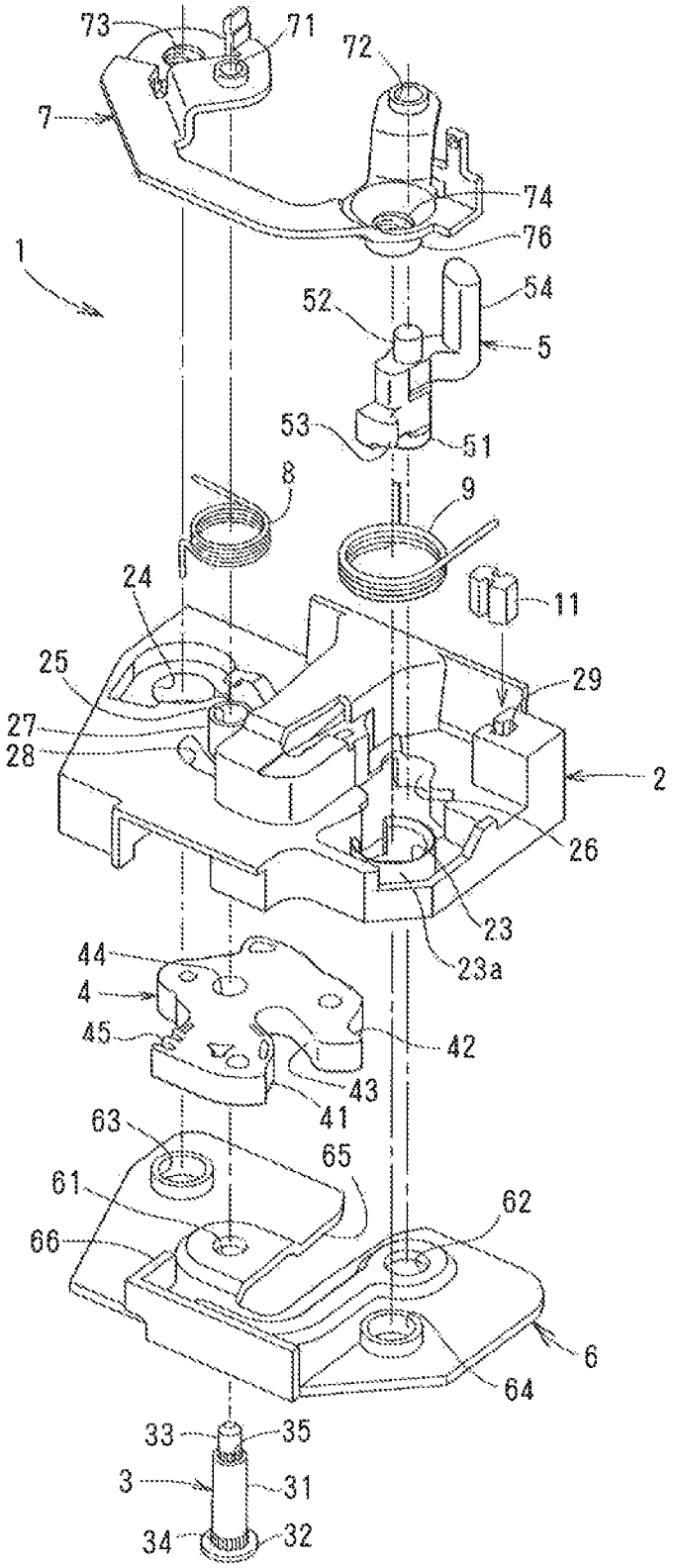
FIG. 6 is an exploded perspective view of the same viewed from above at a different point.
Figure 7:
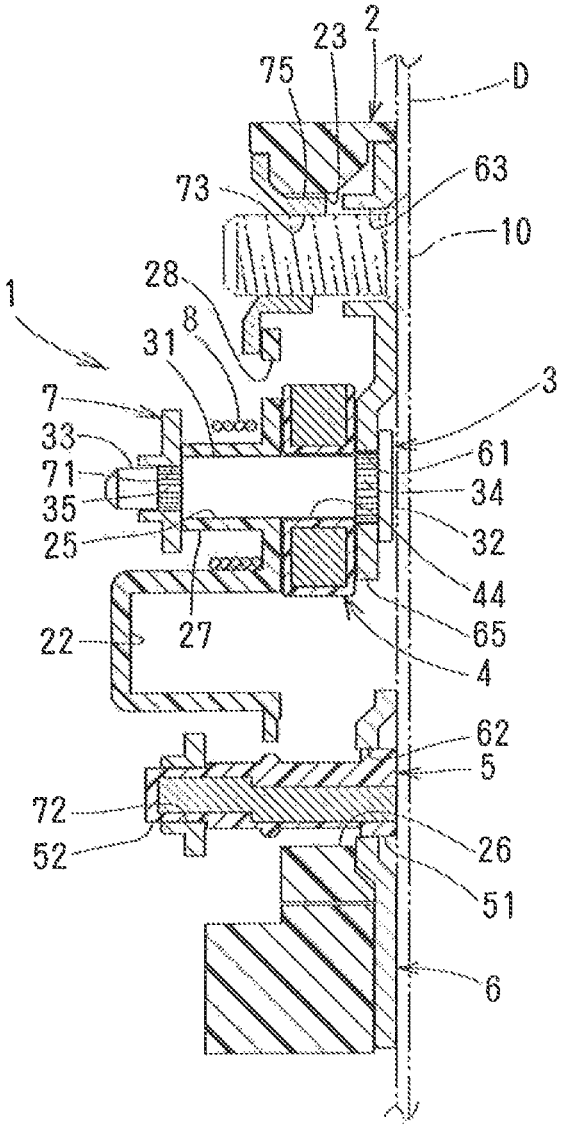
FIG. 7 is a vertical sectional view taken along the line VII-VII in FIG. 3.

In FIG. 7, a door latch device 1 is fixed to a rear end of an inner surface of a door panel D which is supported in a vehicle body to open and close. The door latch device 1 comprises a synthetic-resin body 2 which has a holding portion 21 which has an opening at a front surface. The front surface faces backward when the door latch device 1 is fixed to the door panel D; faces forward in FIGS. 1 and 2; faces backward in FIG. 3; faces downward in FIGS. 4-6; and faces rightward in FIG. 7. The door latch device further 1 comprises a latch 4 pivotally mounted via a latch shaft 3 in the holding portion 21 of the body 2 to engage with a striker S fixed to the vehicle body; a pole 5 which is pivotally mounted about an axis longitudinally of the vehicle body to engage with the latch 4; a metal cover member 6 which closes the opening of the holding portion 21 of the body 2; a metal back member 7; a spring 8 which biases the latch 4 in one direction; and a spring 9 which biases the pole 5 in one direction. The back member 7 is fixed to a back surface. The back surface faces forward when the door latch device 1 is fixed to the door panel D; faces backward in FIGS. 1 and 2; faces forward in FIG. 3; faces upward in FIGS. 4 to 6; and faces leftward in FIG. 7, Besides the holding portion 21, the body 2 comprises a striker-engagement groove 22 in which the striker S engages as shown by an arrow in FIG. 1; bolt-fitting holes 23, 24 into which upper and lower bolts fit; a bearing hole 25 in which the latch shaft 3 fits; and a connecting hole 26 in which the pole 5 fits toward the holding portion 21 from the back surface. On the back surface of the body 2, there is formed a groove 29 which is open on the back surface. A stopper 11 made of rubber to fix the pole 5 in place is mounted to the groove 29.

The latch 4 is pivotally mounted in the holding portion 21 via the latch shaft 3 and comprises a half-latch pawl 41 and a full-latch pawl 42 having outer circumferences with which the pole 5 comes in contact; an engagement groove 43 in which the striker S engages; and a shank hole 44 in which the latch shaft 3 turns.

A cover member 6 is fixed over the front surface of the body 2 to close the opening of the holding portion 21 of the body 1, and comprises a shank hole 61 in which the latch shaft 3 fits so as to not rotate; a shank hole 62 in which a first shank 51 of the pole 5 fits so as to rotate: bolt-fitting holes 63, 64 which are formed by burring so that the upper and lower bolts 10 fit therein; a striker-engagement groove 65 in which the striker S engages; and a stopper 66 for limiting rotation of the latch 4.

The latch shaft 3 comprises a larger-diameter shank portion 31 which runs through the shank hole 61 of the cover member 6, the shank hole 44 of the latch 4 and the bearing hole 25 of the body 2; a retaining head 32 which is in contact with the front surface of the cover member 6 around the shank hole 61; and a smaller-diameter shank portion 33 which is smaller in diameter than the larger-diameter shank portion 31 and is pressingly fitted into a shank hole 71 of the back member 7 to prevent it from rotation.

There is formed a larger-diameter retaining portion 34 by knurling on the outer circumference of the proximal end of the larger-diameter shank portion 31 of the latch shaft 3 so that the proximal end of the larger-diameter shank portion 31 can pressingly be fitted into the shank hole 61 of the cover member 6; and there is formed a smaller-diameter retaining portion 35 made by knurling on the outer circumference of the distal end of the smaller-diameter shank portion 33 so that the smaller-diameter shank portion 33 can pressingly be fitted into the shank hole of the back member 7.

The spring 8 for biasing the latch 4 in one direction is a torsion spring, and a coil of the spring 8 is wound on the outer circumference of a cylinder 27 in which the bearing hole 25 of the body 2 is formed. One end of the spring 8 is attached to the back surface of the body 2, and the other end is attached to the latch 4 through the opening 28 of the body 2 thereby biasing the latch 4 in one direction or an opening direction which is clockwise in FIGS. 1 and 2.

A metal plate is stamped to form a core of the pole 5, and the core is covered with synthetic resin which is molded. At one end of the pole 5, there are a first shank 51 cylindrically formed from synthetic resin and put into the shank hole 62 of the cover member 6 to be rotatable, and a second shank 52 cylindrically formed from synthetic resin and put into the shank hole 72 of the back member 7. Between the first shank 51 and the second shank 52, there are an engagement portion 53 which can selectively engage with the half-latch pawl 41 or the full-latch pawl 42, and a releasing portion 54 with which a release lever (not shown) moving door-opening operation of an outside handle (not shown) and an inside handle (not shown) of the door panel D can come in contact. The pole 5 may pivotally be mounted in the holding portion 21 of the body 2 via a separate shaft.

The spring 9 for biasing the pole 5 in one direction is a torsion spring, and a coil of the spring 9 is wound on the outer circumference of a cylindrical portion 23*a* in which a bolt-insertion hole 23 is formed in FIG. 6. One end of the coil engages with the back surface of the body 2, and the other end engages with the pole 5, thereby biasing the pole 5 in one direction or in an engagement direction which is counterclockwise in FIGS. 1 and 2.

The back member 7 has the shank hole 71 into which the smaller-diameter shank portion 33 of the latch shaft 3 is pressingly fitted; a shank hole 72 in which the shank 52 of the pole 5 is rotatably disposed; and threaded holes 73,74 on which the bolts 10,10 engage.

The shank holes 71,72 are molded by burring. Burrs about the shank holes 71,72 project on the back surface of the back member 7. Threaded holes 73,74 are formed within cylindrical portions 75,76 formed by burring.

How to Work the Door Latch Device 1

The door latch device 1 is fixed by inserting the upper and lower bolts into a hole (not shown) of the door panel D, the bolt-insertion holes 63,64 of the cover member 6 and the threaded holes 73,74 of the back member 7. When the door latch device 1 is fixed to the door panel D, the front surface of the cover member 6 and the front surface of the retaining head 32 face and contact the inner surface of the door panel D in FIG. 7. By holding the retaining head 32 of the latch shaft 3 between the front surface of the cover member 6 and the inner surface of the door panel D, the latch shaft 3 is prevented from moving axially.

Figure 1:
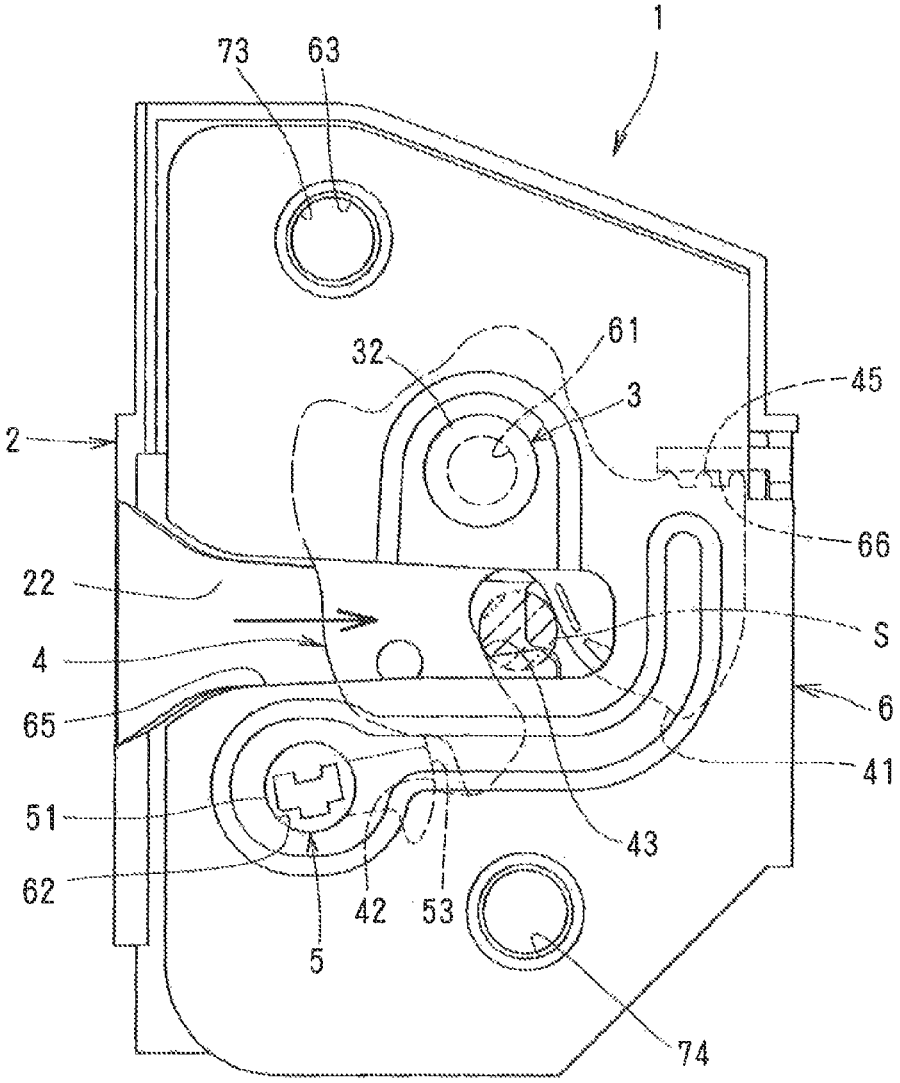
FIG. 1 is a front elevational view of the first embodiment of a door latch device according to the present invention.
Figure 2:
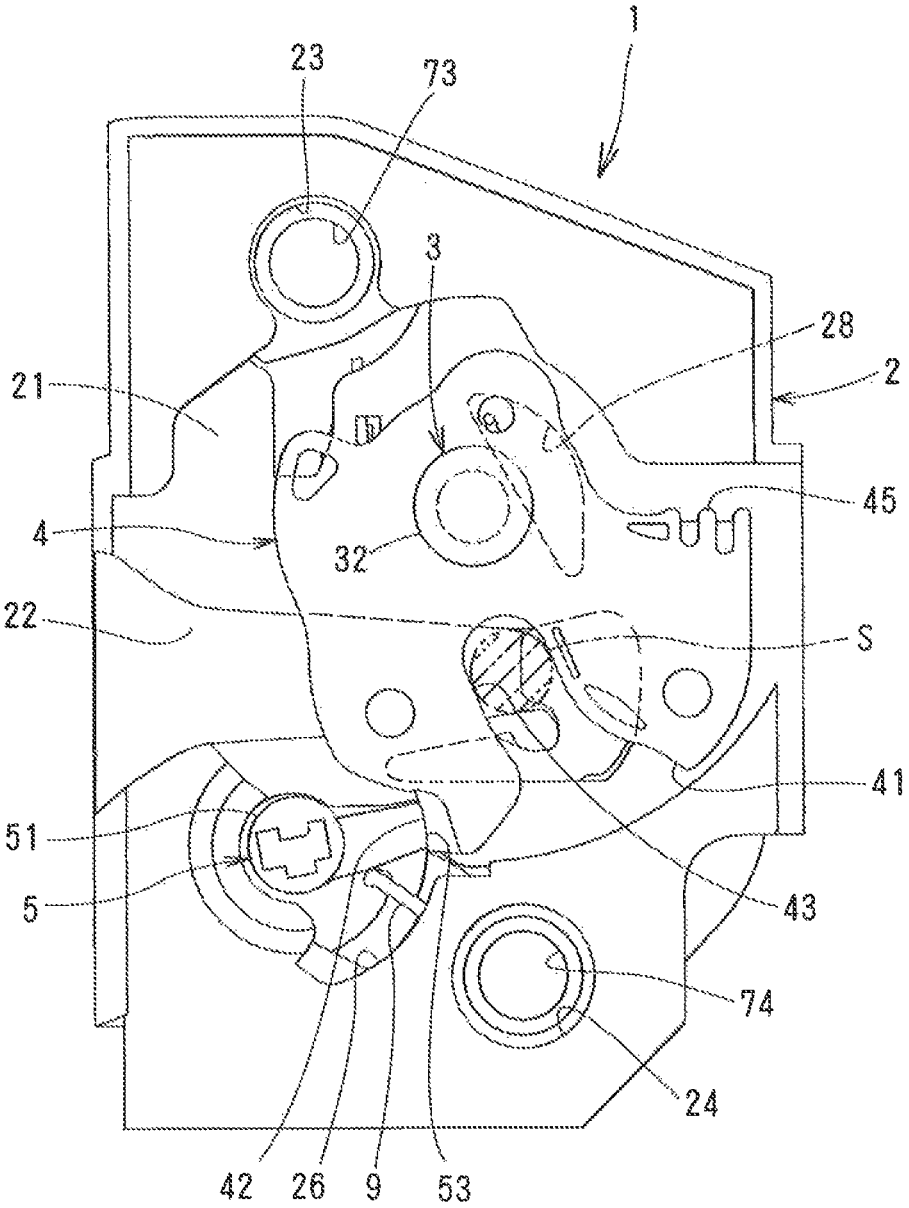
FIG. 2 is a front elevational view of the same, when a cover member is taken off.
Figure 3:
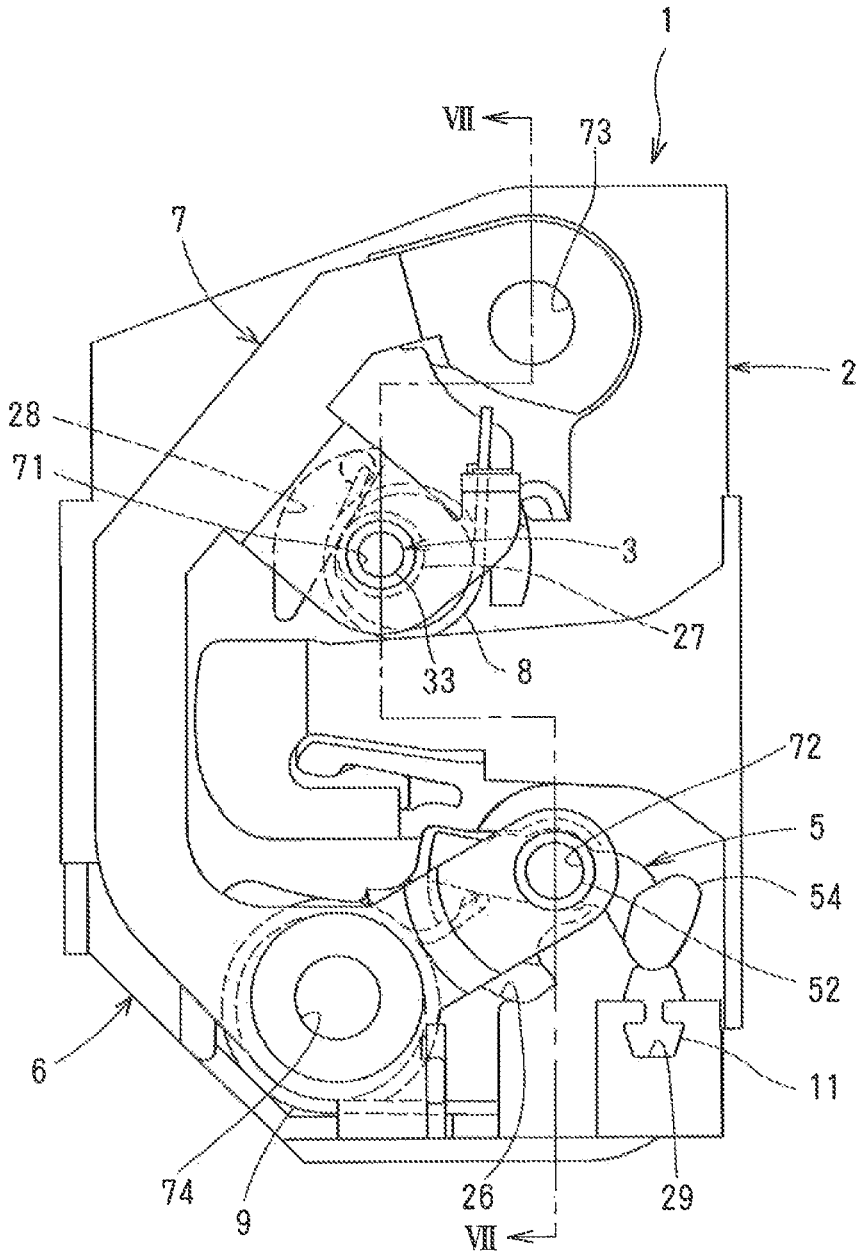
FIG. 3 is a rear elevational view of the same.
Figure 4:
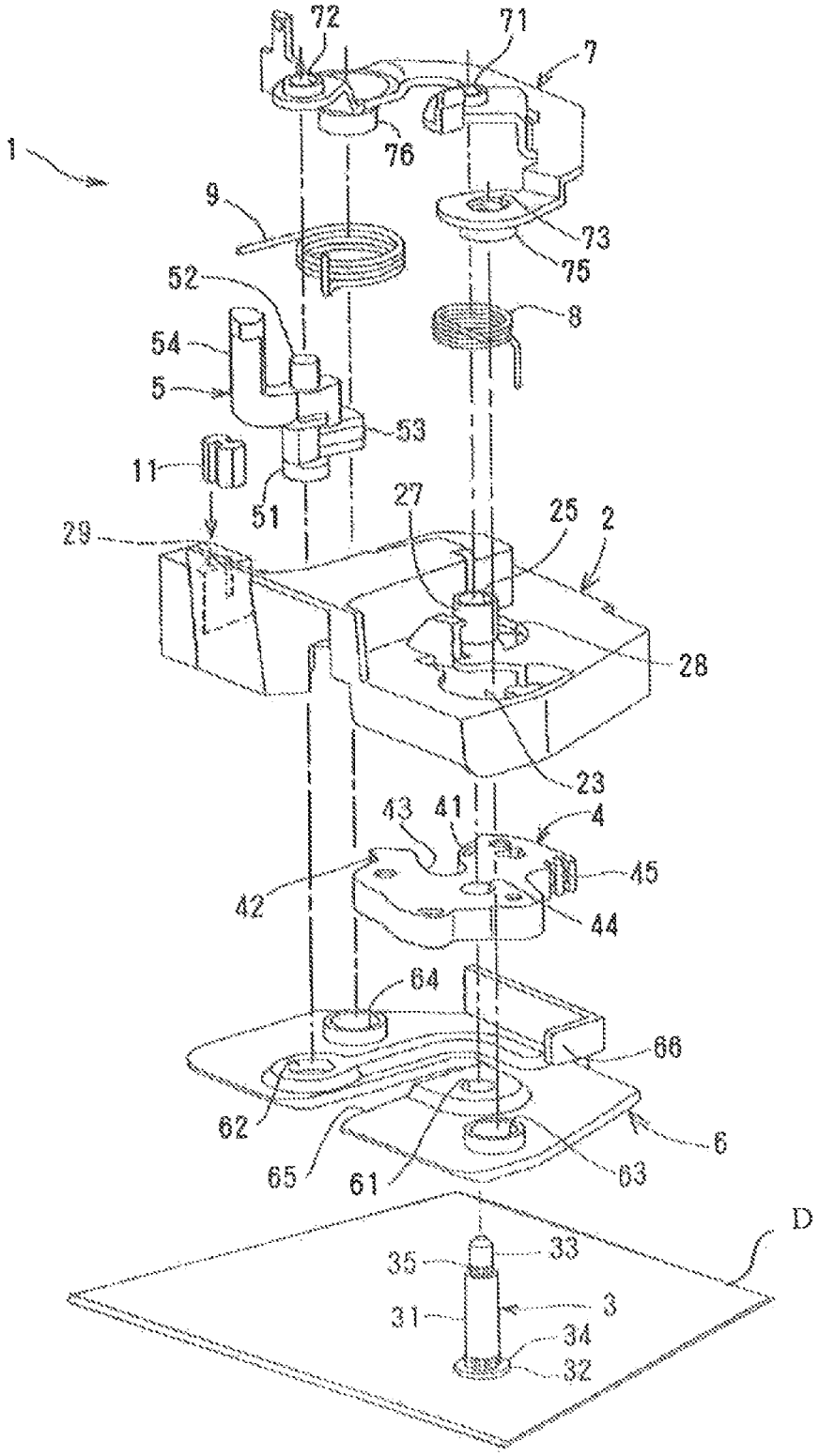
FIG. 4 is an exploded perspective view of the same viewed from above.
Figure 5:
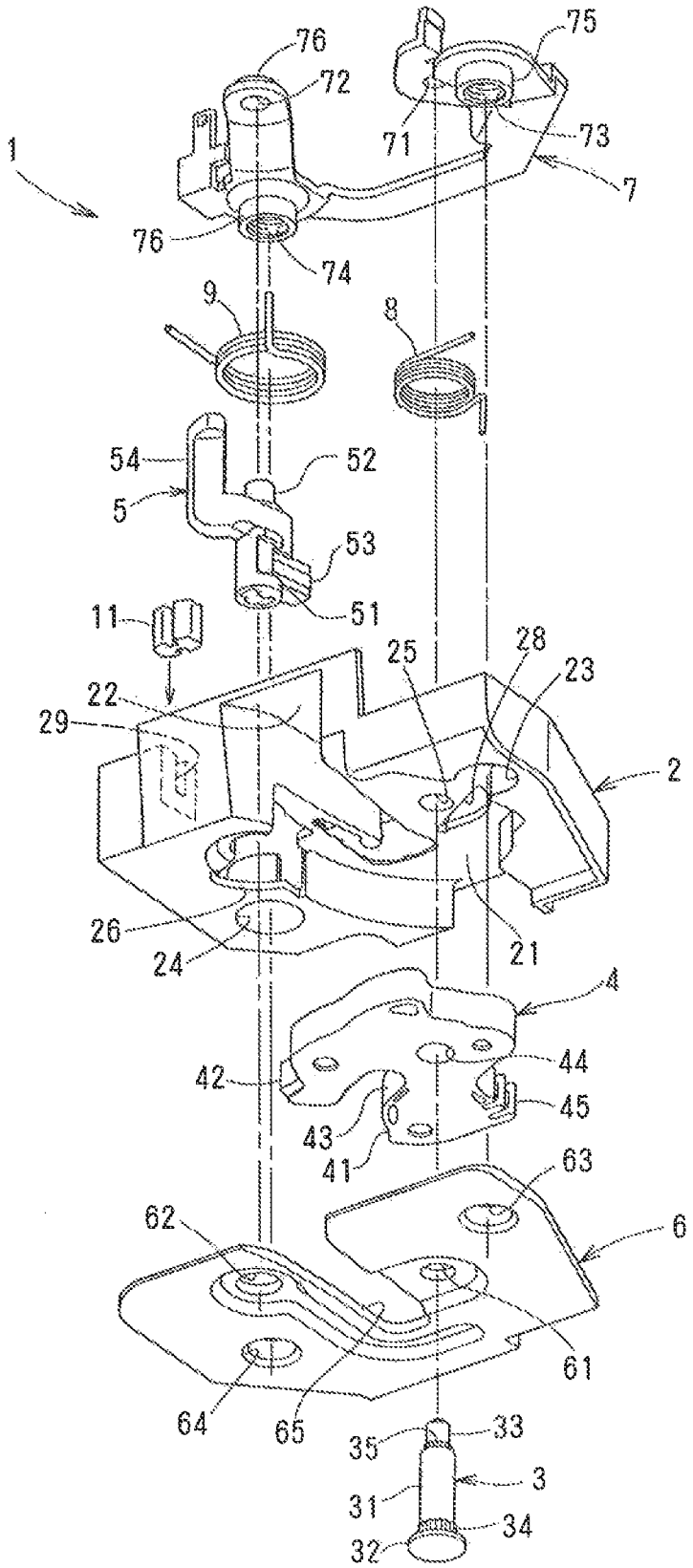
FIG. 5 is an exploded perspective view of the same viewed from below.

When the door panel D is open, the latch 4 is held in an open position where the latch 4 turns clockwise from the full-latch position in FIGS. 1 and 2 by about 90 degrees. When the door panel D is closed, the striker S engages in the striker-engagement grooves 22,65 of the body 2 and the cover member 6, the striker S engages in the striker-engagement groove 43 of the latch 4. Thus, the latch 4 turns clockwise from the open position at a certain angle against force of the spring 8 to the full-latch position in FIGS. 1 and 2 via a half-latch position.

When the latch 4 turns to the full-latch position, the engagement portion 53 of the pole 5 engages with the full-latch pawl 42 to prevent the latch 4 from turning from the full-latch position in an opening direction or clockwise in FIGS, 1 and 2 to hold the door panel D in a fully-closed position.

When the door panel D is in the fully-closed position, a release lever (not shown) is actuated with door-opening operation of the handle, the release lever partially comes in contact with the releasing portion 54 of the pole 5 from below. The pole 5 turns at a certain angle in a releasing direction or clockwise in FIGS. 1 and 2 against force of the spring 9 to disengage the engagement portion 53 from the full-latch pawl 42 of the latch 4 to enable the door panel D to open.

How to Assemble the Door Latch Device 1

First, the latch shaft 3 is inserted into the shank holes 61 from the front surface of the cover member 6, and the larger-diameter retaining portion 34 is pressingly fitted into the shank hole 61, so that the larger-diameter shank portion 31 is fixed to the cover member 6. Thus, during assembling, even if the direction of the cover member 6 is changed, the latch shaft 3 does not disengage from the full-latch pawl 42 of the latch 4.

The cover member 6 to which the latch shaft 3 is fixed is set to a jig while the front surface of the cover member 6 faces downward. The latch shaft 3 is inserted into the shank hole 44 of the latch 4 from the back surface of the cover member 6, so that the latch 4 is set at a predetermined assembling position of the cover member 6 or at a position where a buffer 45 of the latch 4 is in contact with the stopper 66 of the cover member 6.

The latch 4 is covered with the body 4 from the back surface of the cover member 6. At the same time, the larger-diameter shank portion 31 of the latch shaft 3 which projects from the shank hole 44 of the latch 4 is inserted into the bearing hole 25 of the body 2.

The stopper 11 is fitted into the groove 29 of the body 2 from the back surface of the body 2. The first shank 51 is inserted in the shank hole 62 of the cover member 6 through the connecting hole 26 of the body 2. Thus the pole 5 is set to a predetermined position where the releasing portion 54 is in contact with the stopper 11 in FIG. 3.

The coil of the spring 8 is wound on the outer circumference of the cylindrical portion 27 of the body 2 from the back surface of the body 2. At the same time, one end of the coil is engaged with latch 4 through the opening 28 and the other end is engaged with the body 2. The coil of the spring 9 is wound on the outer circumference of the body 2, and one end of the coil is engaged with the body 2, while the other end is engaged with the pole 5.

While the smaller-diameter shank portion 33 of the latch shaft 3 and the second shank 52 of the pole 5 are inserted into the shank holes 71 and 72 of the back member 7 respectively and the cylindrical portions 75, 76 are engaged in the bolt-insertion holes 23, 24 of the body 2, the back member 7 is set on the back surface of the body 2. The smaller-diameter retaining portion 35 of the latch shaft is pressingly fitted into the shank hole 71 of the back member 7. Thus, the cover member 6, body 2 and back member 7 are fixed to each other with the latch shaft 3. The springs 8,9 are held between the back surface of the body 2 and the back member 7 so that they are not removed from the body 2. The door latch device 1 is finally assembled.

In the door latch device 1 in the first embodiment, while the latch shaft 3 is formerly fixed to the shank hole 61 of the cover member 6, all of the latch 4, body 2, pole 5, springs 8,9 and back member 7 can be connected to the cover member 6 from the same direction thereby assembling the device 1 more efficiently.

The latch shaft 3 is inserted into the shank hole 61 of the cover member 6, shank hole 44 of the latch 4 and bearing hole 25 of the body 2 in order from the front surface of the cover member 6, and the smaller-diameter shank portion 33 on which the smaller-diameter retaining portion 35 is pressingly fitted into the shank hole 71 of the back member 7 and fixed thereto. Without swaging the end of the latch shaft 3, the cover member 6, body 2 and back member 7 are not separated from each other, but are joined to each other thereby assembling the door latch device 1 more efficiently. The shank hole 71 into which the smaller-diameter shank portion 33 is pressingly fitted is formed by burring, so that the smaller-diameter shank portion 33 can firmly be fixed to the shank hole 71 thereby enhancing its strength.

Second Embodiment

Figure 8:
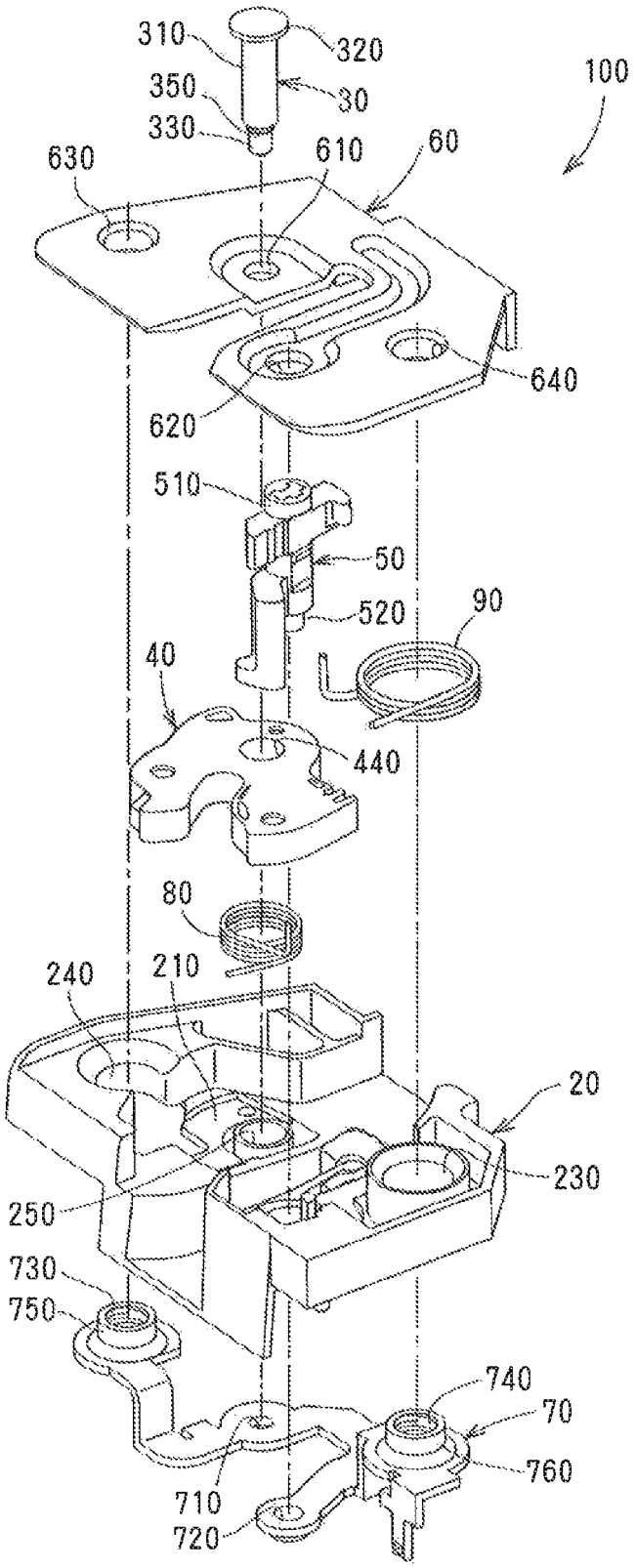
FIG. 8 is an exploded perspective view of the second embodiment of a door latch device according to the present invention, viewed from above.
Figure 9:
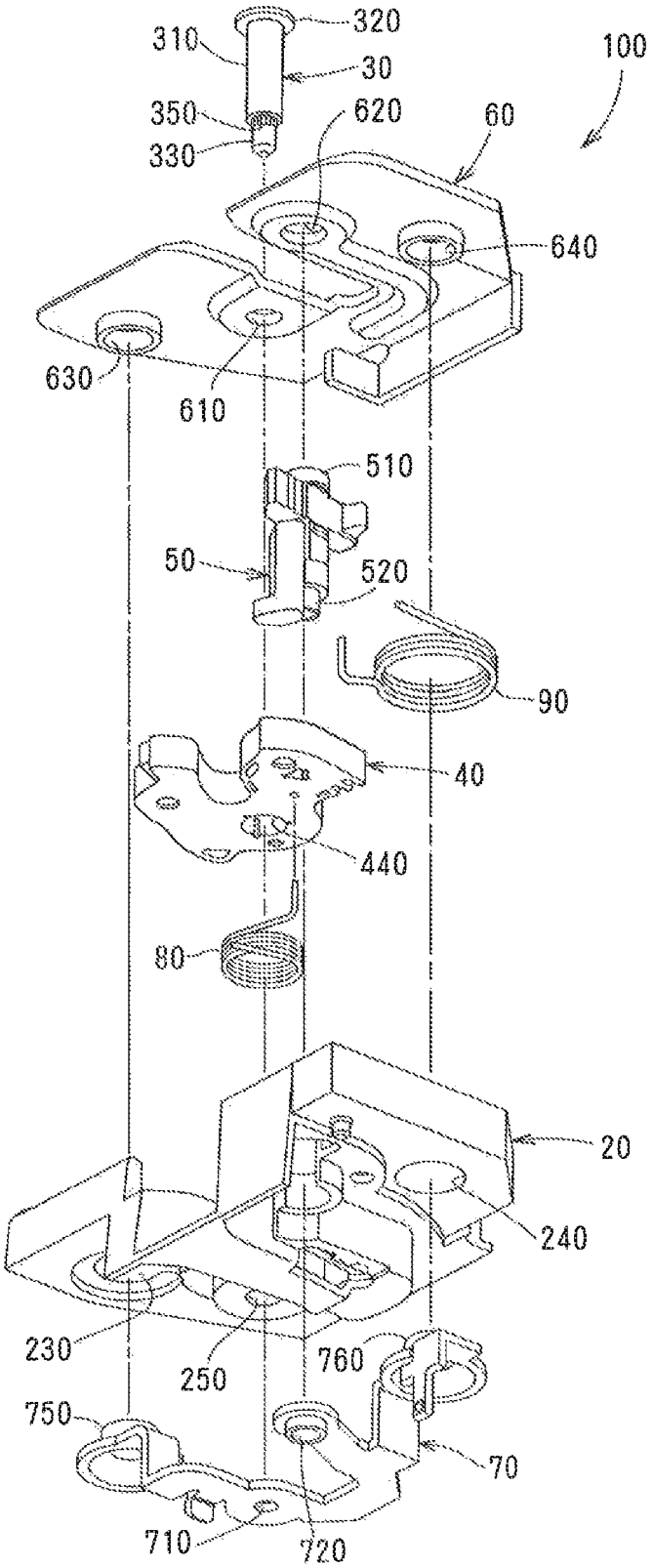
FIG. 9 is an exploded perspective view of the same viewed from below.
Figure 10:
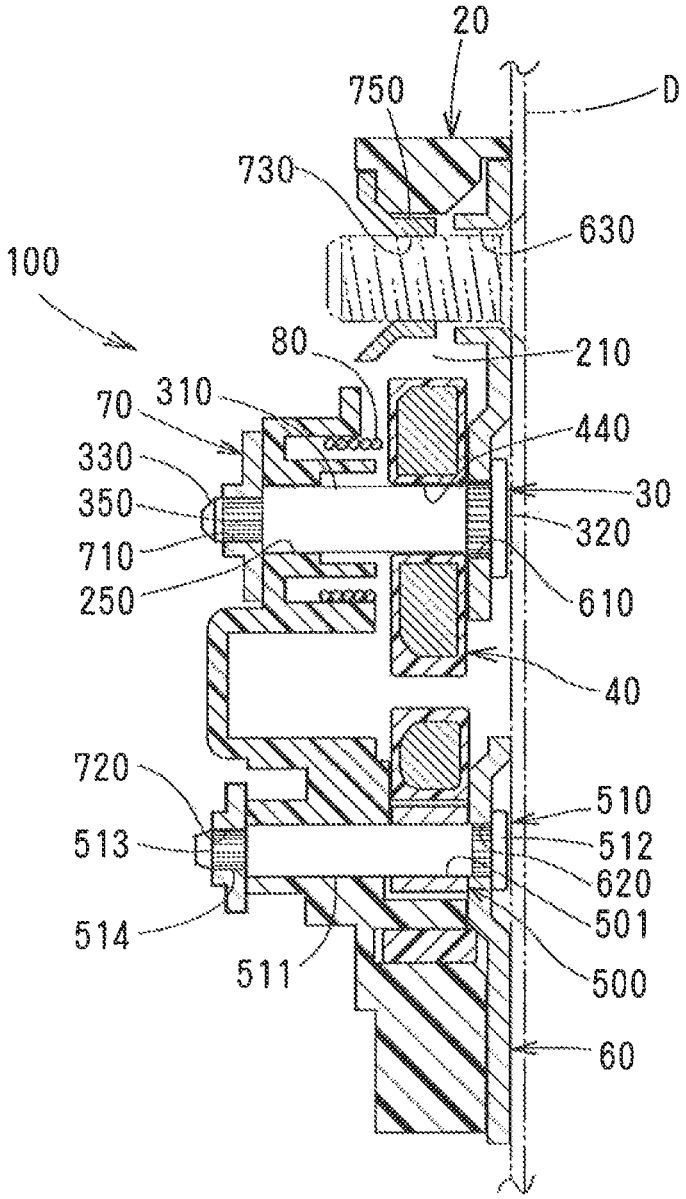
FIG. 10 is a vertical sectional view similar to FIG. 7.

FIGS. 8-10 illustrate a second embodiment of the present invention. A door latch device 100 in the second embodiment comprises a body 20, a latch shaft 30, a latch 40, a pole 50, a cover member 60, a back member 70 and springs 80,90 as well as in the first embodiment. The structural elements in the second embodiment provide the same basic function as those in the first embodiment in spite of difference in shape, and the numeral "0" is added to the end of the elements corresponding to the first embodiment. So, detailed description thereof is omitted.

The second embodiment differs from the first embodiment in a connecting direction for assembling of the door latch device 100. While the elements are connected in order with respect to the cover member 6 in the first embodiment, the elements are put and connected in order with respect to the back member 70 in the second embodiment.

Explaining the assembling of the door latch device 100 in the second embodiment, the back member 70 is set to a jig such that the back surface faces downward.

Then, the body 20 is placed on the front surface of the back member 70 and is determined in an assembling position by fitting cylindrical portions 750,760 of the back member 70 into bolt-insertion holes 230,240 of the body 20

After a spring 80 is connected in a holding portion 210 of the body 20 from the front surface of the body 20, the latch 40 is disposed in the holding portion 210, and a second shank 520 of the pole 50 is inserted in an shank hole 720 of the back member 70 through the body 20, so that the spring 90 is connected in the holding portion 210.

The cover member 60 is placed over the front surface of the body 20 to close the holding portion 210 of the body 20, and a first shank 510 of the pole 50 is rotatably inserted into an shank hole 620 of the cover member 60.

Finally, from the front surface of the cover member 60, the latch shaft 30 is inserted into an shank hole 610, a shank hole 440 of the latch 40 and a bearing hole 250 of the body 20. A smaller-diameter retaining portion 350 on the outer circumference of a smaller-diameter shank portion 330 is pressingly fitted into an shank hole 710 of the back member 70. Thus, the cover member 60, body 20 and back member 70 are not separated from each other, but fixed to each other with the latch shaft 30. In the second embodiment, it is not necessary to caulk the end of the latch shaft 30 as well as in the first embodiment. The latch shaft 30 has no necessity that it is fixed to the cover member 60 at assembling, Hence, the latch shaft 30 has no larger-diameter retaining portion.

In the door latch device 100 of the second embodiment, the body 20, latch 40, pole 50, springs 80,90 and cover member 60 are stacked and assembled on the back member 70. Thereafter, the latch shaft 30 is inserted into the shank hole 610 from the front surface of the cover member 60. The smaller-diameter shank portion 330 is pressingly fitted into the shank hole 710, and all of the elements which consist of the back member 70, body 20, latch 40, pole 50, springs 80,90, cover member 60 and latch shaft 30 are connected in the same direction, thereby assembling the device 1 more efficiently.

As in the first embodiment, the latch shaft 30 is inserted into the shank hole 610 of the cover member 60 from the front surface of the cover member 60, and the smaller-diameter shank portion 330 in which the smaller-diameter retaining portion 350 is pressingly fitted into the shank hole 710 of the back member 70 and fixed. Even without swaging the end of the latch shaft 30, the cover member 60, body 20 and back member 70 are fixed and cannot be separated from each other, thereby assembling the door latch device 1 more efficiently.

The cover member 60 has bolt-fitting holes 630, 640 and the back member 70 has threaded holes 730, 740. The door latch device 100 is fixed to the door panel D with a bolt through a hole of the door panel D, the bolt-fitting hole 630 and the threaded hole 730 and with a bolt through a hole of the door panel D, the bolt-fitting hole 640 and the threaded hole 740.

Figure 11:
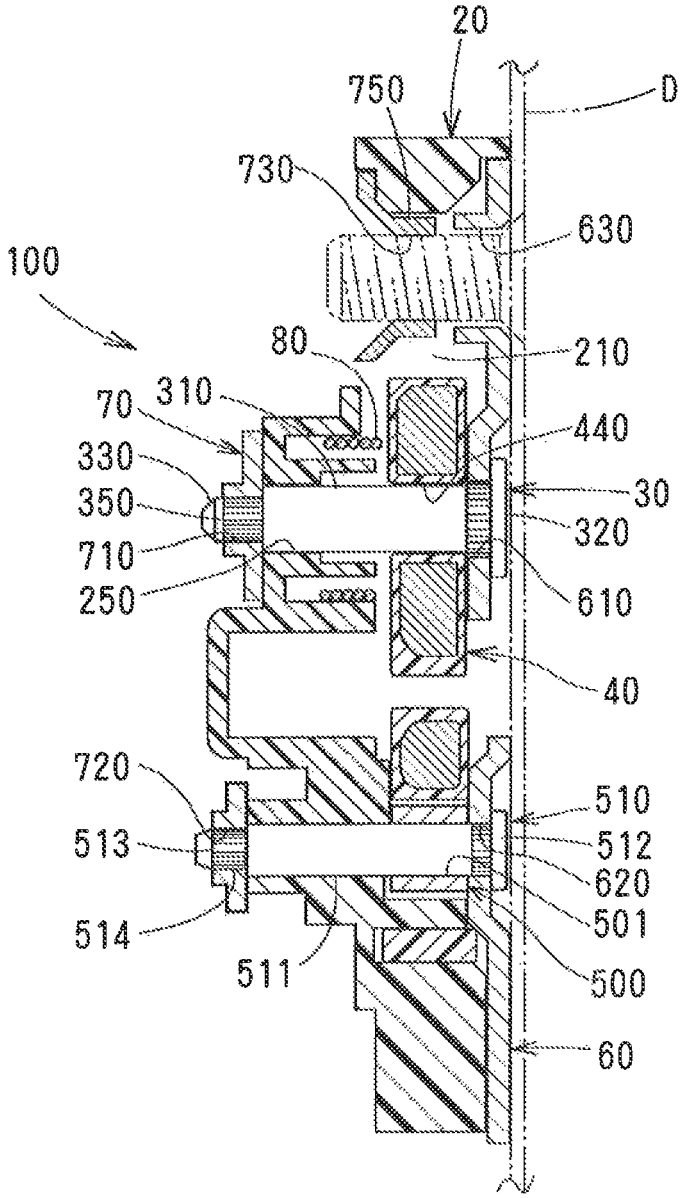
FIG. 11 is a vertical sectional view similar to FIG. 7 with respect to the third embodiment.

The foregoing relates to the embodiments of the present invention. Without departing from the scope of appended claims, various changes and modifications may be made as below:

In a third embodiment in FIG. 11, a pole 500 and a pole shaft 510 which is separate from the pole 500 are pivotally mounted in a holding portion of a body 20. A pole shaft 510 comprises an shank 511 which runs through a shank hole 620 of a cover member 60 and an shank hole 501 of a pole 500 from the front surface of a cover member 60; a retaining head 512 which is situated at a proximal end of the shank 511 which runs through an shank hole 620 of the cover member 60 and is in contact with part around an shank hole 620 of the cover member 60; a smaller-diameter shank 514 which is smaller in diameter than the shank 511 at a distal end of the shank 511, a smaller-diameter retaining portion 513 of the smaller-diameter shank 514 being pressingly fitted into an shank hole 720 of a back member 70. The shank 511 of the pole shaft 510 runs through the shank hole 620 of the cover member 60 and the shank hole 501 of the pole 500, and the smaller-diameter shank 514 is pressingly fitted in the shank hole 720 of the back member 70 without swaging the end of the shank 514.

Instead of the embodiment in FIG. 11, the pole shaft 510 comprises a shank 511 which passes through the shank hole 720 of the back member 70 and the shank hole 501 of the pole 500 from the back surface of the back member 70; the retaining head 512 which is situated at the proximal end of the shank 511 which runs through the shank hole 720 of the back member 70: and a smaller-diameter shank 514 which is smaller in diameter than the shank 511 at the distal end of the shank 511, the smaller-diameter retaining portion 513 of the smaller-diameter shank 514 being pressingly fitted into the shank hole 620 of the cover member 6.

The shank 511 of the pole shaft 510 runs through the shank hole 720 of the back member 70 and the shank hole 501 of the pole 500, and the smaller-diameter shank 513 is pressingly fitted in the shank hole 620 of the cover member 60 without swaging the end of the shank 513. In this case, the shank hole 620 of the cover member 60 is larger in diameter than the shank hole 720 of the back member 70.

Figure 12:
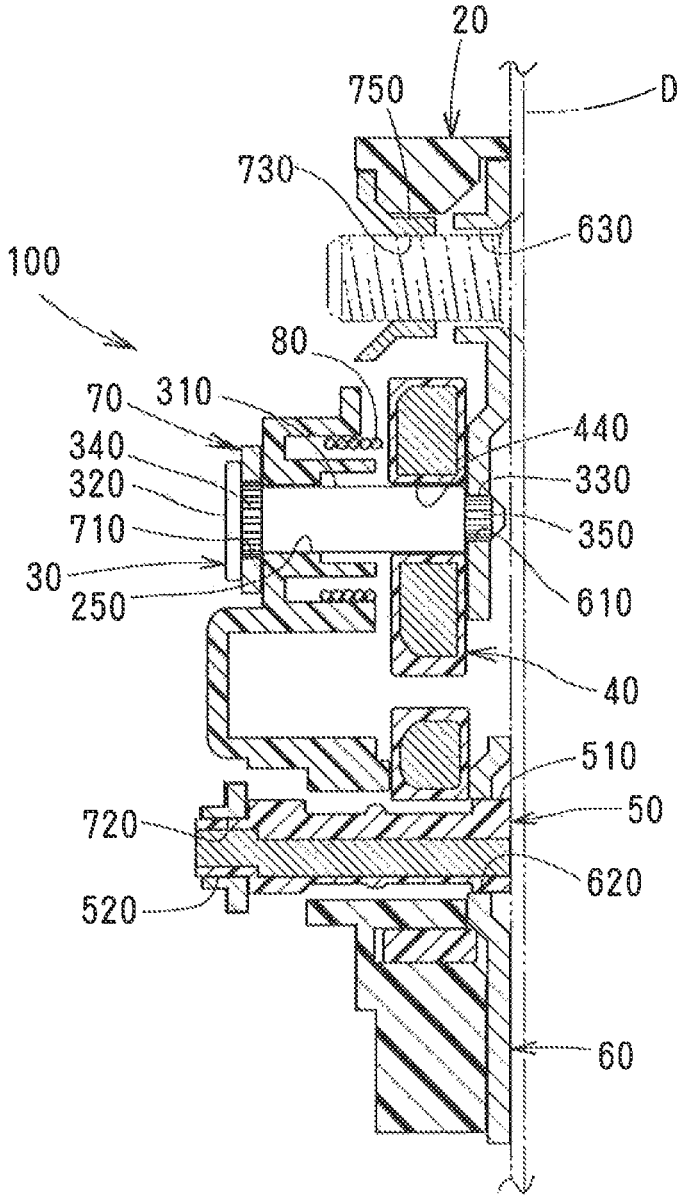
FIG. 12 is a vertical sectional view similar to FIG. 7 with respect to the fourth embodiment.

In a fourth embodiment of FIG. 12, a latch shaft 30 comprises a larger-diameter shank portion 310 which passes through an shank hole 710 of a back member 70, a bearing hole 250 of a body 20 and an shank hole 440 of a latch 40 from the back surface of the back member 70; a larger-diameter retaining portion 340 which is situated on the larger-diameter shank portion 310 at a proximal end where the larger-diameter shank portion 310 passes through the shank hole 710 of the back member 70; and a smaller-diameter shank portion 330 which is smaller in diameter than the larger-diameter shank portion 310 and has a smaller-diameter retaining portion 350 on the outer circumference, the smaller-diameter retaining portion 350 being pressingly fitted in an shank hole 610 of a cover member 60. The larger-diameter shank portion 310 of the latch shaft 30 passes through the shank hole 710 of the back member 70, the bearing hole 250 of the body 20 and the shank hole 440 of the latch 40, and the smaller-diameter retaining portion 350 is pressingly fitted in the shank hole 610 of the cover member 60.

Figure 13:
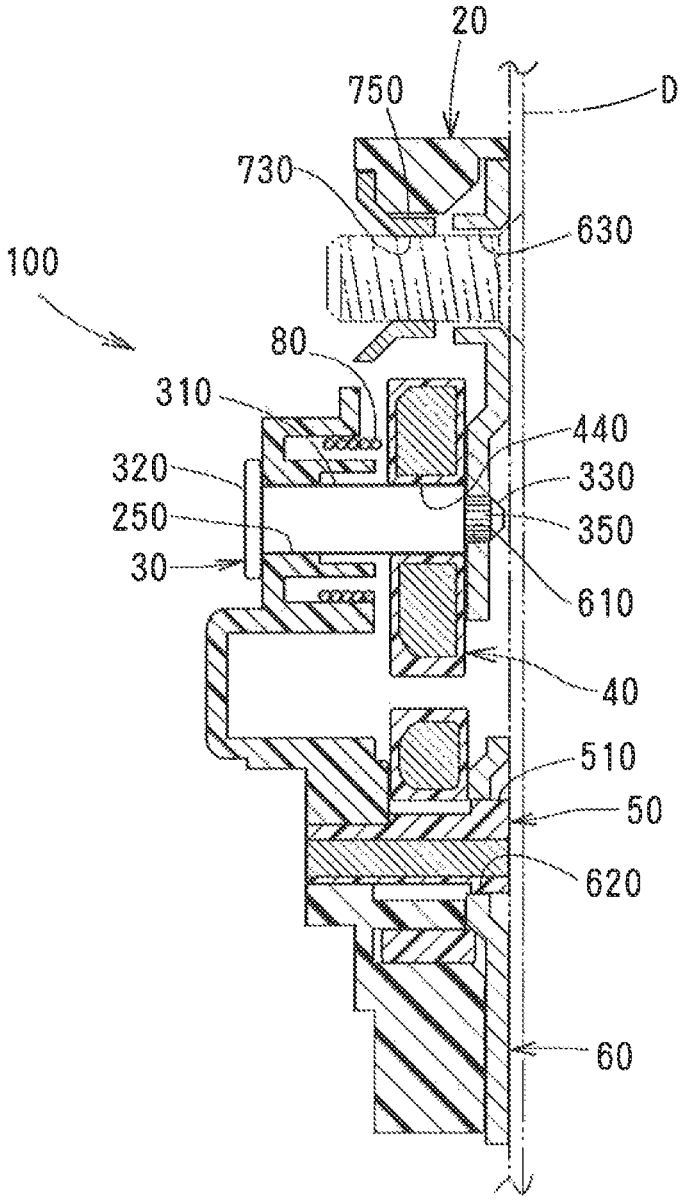
FIG. 13 is a vertical sectional view similar to FIG. 7 with respect to the fifth embodiment.

In a fifth embodiment of FIG. 13, there is no back member 70 on the back surface of a body 20. A latch shaft 30 comprises a larger-diameter shank portion 310 which passes through a bearing hole 250 of the body 20 and an shank hole 440 of a latch 40 from the back surface of the body 20; a retaining head 320 which is situated at a proximal end at the larger-diameter shank portion 310 where the larger-diameter shank portion 310 passes through the bearing hole 250 of the body 20, and a smaller-diameter shank portion 330 which is smaller in diameter than the larger-diameter shank portion 310 at a distal end of the larger-diameter shank portion 310 and a smaller-diameter retaining portion 350 on the outer circumference, the smaller-diameter retaining portion 350 being pressingly fitted into an shank hole 610 of a cover member 60. The larger-diameter shank portion 310 of the latch shaft 30 passes through the bearing hole 250 of the body 20 and the shank hole 440 of the latch 40, and the smaller-diameter retaining portion 350 of the smaller-diameter shank portion 330 is pressingly fitted in the shank hole 610 of the cover member 60 without swaging the end of the smaller-diameter shank portion.

What is claimed is:

1. A vehicle door latch device comprising:

a body having a holding portion being open to form an opening along a first surface and closed along a second surface;

a latch being pivotally mounted in the holding portion of the body;

a pole being pivotally mounted in the holding portion of the body and interacting with the latch;

a cover member being provided along the first surface so as to cover the opening of the holding portion;

a back member being supported on the second surface of the body;

a bolt that fixes the body to a door panel such that the first surface faces the door panel; and a latch shaft that supports and facilitates pivoting of the latch;

wherein the latch shaft comprises a retaining head, a larger diameter retaining portion, a larger-diameter shank portion, a smaller diameter retaining portion, and a smaller-diameter shank portion;

the larger-diameter shank portion of the latch shaft passes through a shank hole of the cover member and a shank hole of the latch;

the retaining head is disposed at a proximal end of the larger-diameter shank portion and engages with a front surface of the cover member adjacent the shank hole;

the smaller-diameter shank portion is disposed at a distal end of the larger-diameter shank portion, and the smaller-diameter shank portion is smaller in diameter than the larger-diameter shank portion;

the smaller diameter retaining portion is pressingly fitted into a shank hole of the back member to secure the latch shaft to the back member without swaging an end of the smaller-diameter shank portion; and the larger diameter retaining portion of the latch shaft, proximate to the retaining head, is knurled so that the larger diameter retaining portion is pressingly fitted into the shank hole of the cover member.

2. The vehicle door latch device of claim 1, wherein the shank hole of the back member is formed by burring.

3. The vehicle door latch device of claim 1, wherein the smaller diameter retaining portion is formed by knurling.

* * * * *